US005785555A

United States Patent [19]

O'Sullivan et al.

[11] Patent Number: 5,785,555

[45] Date of Patent: *Jul. 28, 1998

[54] SYSTEM FOR TERMINATING THE SHIELD OF A HIGH SPEED CABLE

[75] Inventors: Michael O'Sullivan, Willowbrook; Paul Murphy, Naperville, both of Ill.

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 609,666

[22] Filed: Mar. 1, 1996

[51] Int. Cl.[6] ..... H01R 13/648

[52] U.S. Cl. ..... 439/610; 439/585; 439/108; 439/874

[58] Field of Search ..... 439/578–585, 439/607–610, 92, 108, 874

[56] References Cited

U.S. PATENT DOCUMENTS

| | | | |
|---|---|---|---|
| 3,566,008 | 2/1971 | Ettlinger | 439/874 |
| 4,615,578 | 10/1986 | Stadler et al. | 339/143 |
| 4,810,210 | 3/1989 | Komatsu | 439/610 |
| 4,813,888 | 3/1989 | Tokizane et al. | 429/583 |
| 5,061,827 | 10/1991 | Grabbe | 174/756 |
| 5,190,473 | 3/1993 | Mroczkowski et al. | 439/580 |
| 5,195,910 | 3/1993 | Enomoto et al. | 439/874 |
| 5,197,893 | 3/1993 | Morlion et al. | 439/101 |
| 5,304,069 | 4/1994 | Brunker et al. | 439/108 |
| 5,415,568 | 5/1995 | Kinoshita | 439/610 |

FOREIGN PATENT DOCUMENTS

| | | |
|---|---|---|
| 0 385 020 B1 | 7/1996 | European Pat. Off. . |
| 2 718 299 A1 | 6/1995 | France . |

*Primary Examiner*—J. J. Swann
*Attorney, Agent, or Firm*—Charles S. Cohen

[57] ABSTRACT

A system is disclosed for terminating the shield of a high speed cable having an outer jacket and an inner metallic shield with a. portion of the outer jacket removed to expose a portion of the metallic shield. The system includes a conductive two-part. terminating member including a cable receiving part and a terminal part. The cable receiving part includes a receptacle for receiving the high speed cable in direct engagement with the exposed metallic shield thereof. A solder connection is applied between the exposed metallic shield and the cable receiving part at the receptacle. The terminal part is adapted for grounding the metallic shield. The cable receiving part is mounted on the terminal part in conductivity therewith.

9 Claims, 4 Drawing Sheets

SYSTEM FOR TERMINATING THE SHIELD OF A HIGH SPEED CABLE

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved system or terminal for terminating the metallic shields of high speed cables.

In the exemplary embodiment of the invention, the system is adapted for terminating the shield of a high speed cable having an outer jacket and an inner metallic shield with a portion of the outer jacket removed to expose a portion of the metallic shield. The system includes a conductive two-part terminating member including a cable receiving part and a terminal part. The cable receiving part includes a receptacle for receiving the high speed cable in direct engagement with the exposed metallic shield thereof. A solder connection is applied between the exposed metallic shield and the cable receiving part at the receptacle. The terminal part is adapted for grounding the metallic shield. Complementary interengaging mounting means are provided between the cable receiving part and the terminal part for mounting the cable receiving part on the terminal part in conductivity therewith.

As disclosed herein, the terminal part comprises a ground plate. The cable receiving part includes a pair of the receptacles on each opposite side of the ground plate for receiving a pair of high speed cables in a generally parallel side-by-side relationship on both opposite sides of the ground plate. The receptacles are substantially cylindrical.

In the preferred embodiment, each part is stamped and formed of conductive sheet metal material. The terminal part comprises a generally planar ground plate having a pair of projecting positioning arms on each side thereof for locating the cable receiving part therebetween. The complementary interengaging mounting means include a pair of spring jaws on the cable receiving part for gripping the terminal part between the projecting positioning arms thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
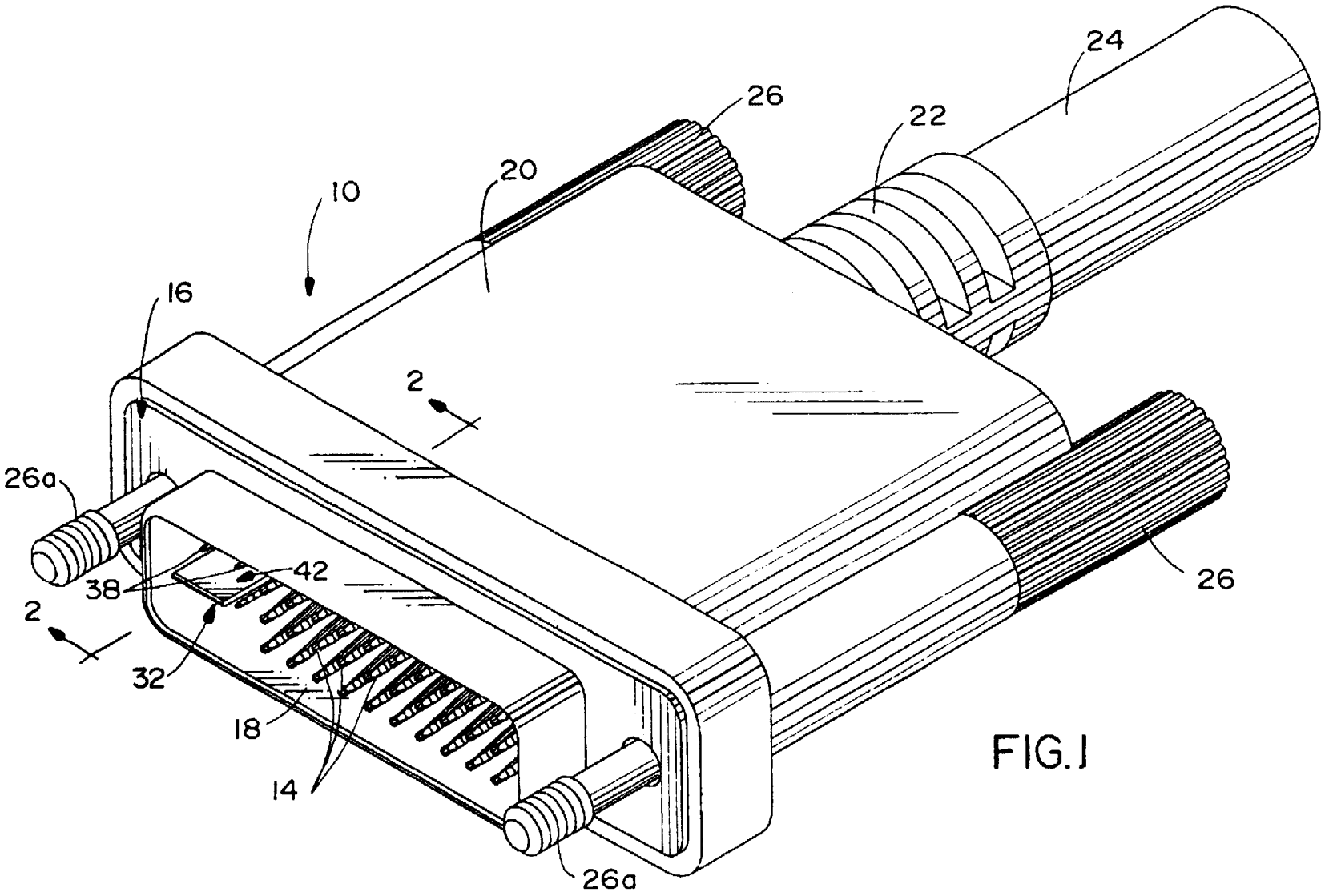
FIG. 1 is a perspective view of an electrical connector of a type in which the invention is applicable.
Figure 2:
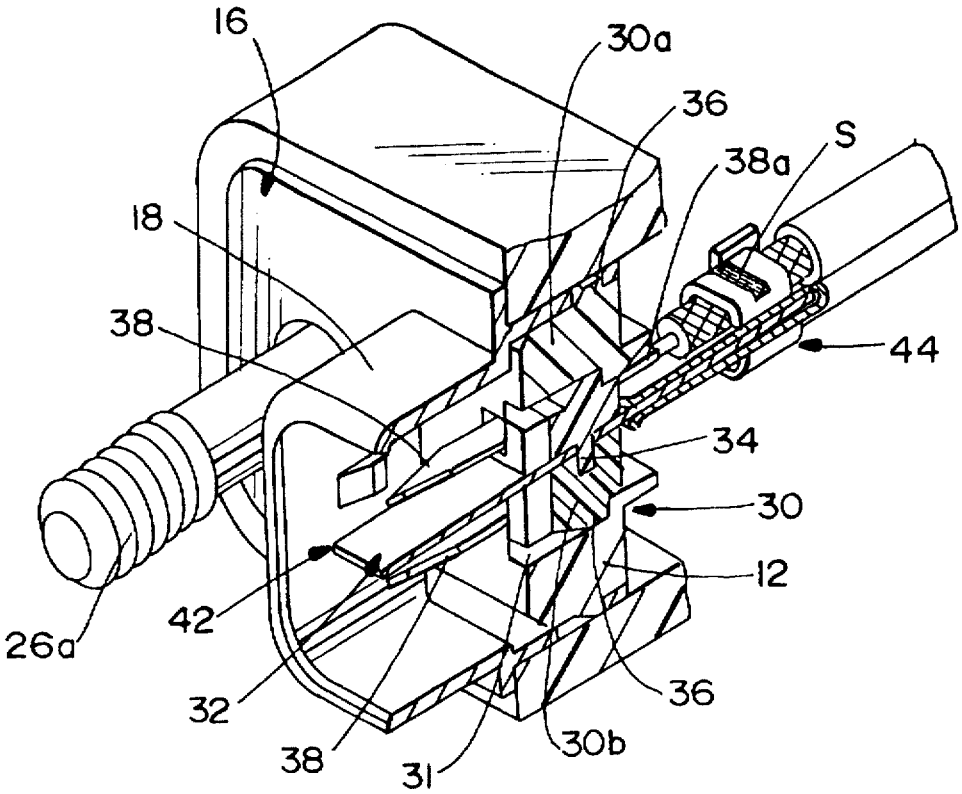
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown) substantially in conformance with that shown in U.S. Pat. No. 5,358,428, dated Oct. 25, 1994, projects rearwardly of housing 12 and shield 16. An overmolded boot 20 includes an integral cable strain-relief 22 that is in engagement with a composite electrical cable 24 which includes both the data transmission lines and the high speed or high frequency transmission lines. A pair of thumb screws 26 project through the overmolded boot and include externally threaded forward distal ends **26*a*** for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of identical terminal blocks **30*a* and 30*b* which clamp a ground plate, generally designated 32, therebetween. Each terminal block includes a post 34 and a recess. The post from each terminal block extends from each terminal block through a hole or slot 44 (FIG. 3) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36** on each terminal block.

Each terminal block **30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 9) are terminated to the center conductor/cores 52 of a plurality of coaxial cables, generally designated 40 in FIG. 2. The invention is particularly directed to the manner of termination of the metallic shields of the coaxial cables to ground plate 32**, as described below.

Figure 4:
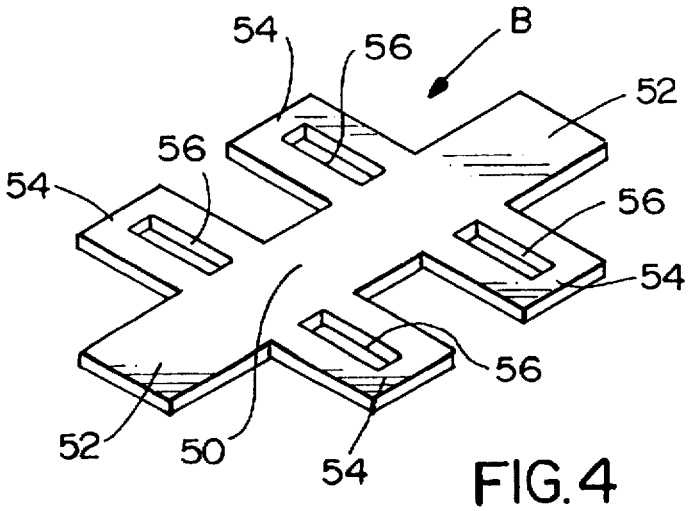
FIG. 4 is a perspective view of a stamped metal blank from which the cable receiving part of the two-part terminating member is formed.
Figure 6:
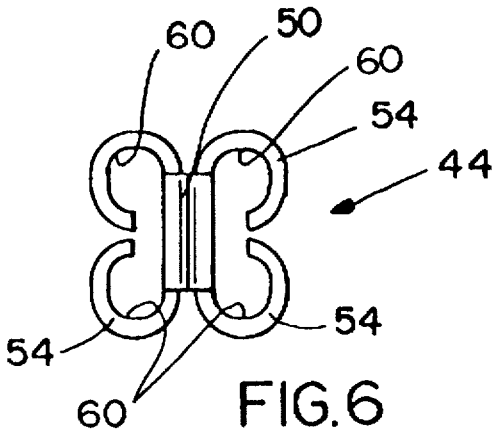
FIG. 6 is end elevational view of the cable receiving part.
Figure 5:
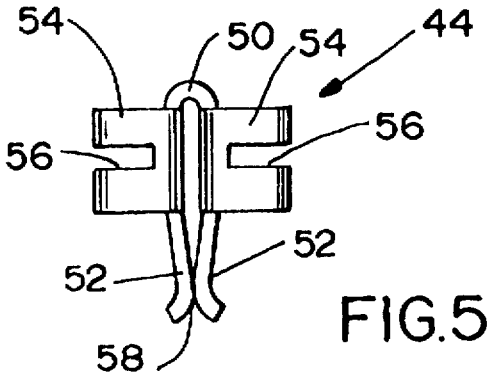
FIG. 5 is a side elevational view of the cable receiving part.
Figure 3:
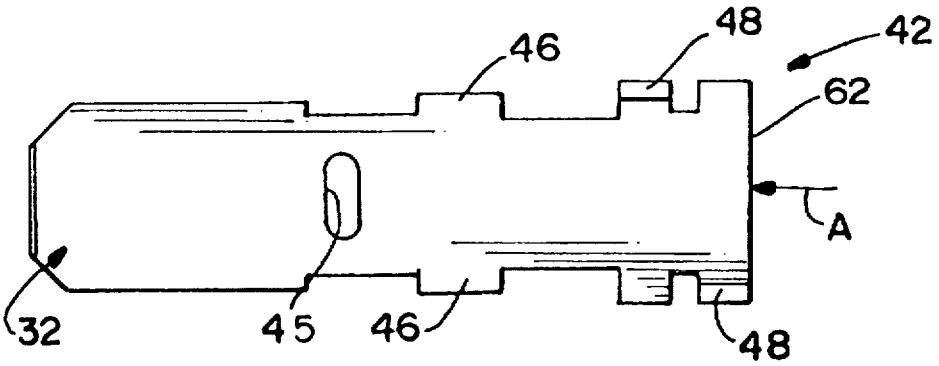
FIG. 3 is a plan view of the terminal part of the two-part terminating member.

More particularly, the invention contemplates a two-part terminating member which includes a terminal part, generally designated 42 in FIG. 3, and a cable receiving part, generally designated 44 in FIGS. 4–6. Actually, ground plate 32 forms an elongated, generally planar blade portion of terminal part 42 as shown clearly in FIG. 3. The ground plate includes aperture 45 (FIG. 3) through which posts 34 (FIG. 2) of terminal blocks **30*a* and 30*b* extend. The terminal part is stamped and formed from conductive sheet metal material, and a pair of barbs or teeth 46 are stamped at the opposite edges of ground plate 32 to facilitate holding the subassembly of the ground plate and terminal blocks 30*a* and 30*b* within the housing. Finally, a pair of staggered positioning arms 48 project from each opposite side of ground plate 32, at opposite edges thereof, for positioning and receiving cable receiving part 44** therebetween in the direction of arrow "A" (FIG. 3).

Referring to FIGS. 4–6, cable receiving part 44 also is stamped and formed from conductive sheet metal material. FIG. 4 shows a blank, generally designated "B," stamped from conductive sheet metal material and from which the cable receiving part is formed. The blank includes an elongated planar base 50 having longitudinally projecting end portions 52. The end portions will form the spring jaws of the cable receiving part, as will be seen hereinafter. A pair of wings 54 project laterally outwardly from each side of base 50 of blank "B." These wings will form the positioning and gripping arms of the cable receiving part, as will be seen hereinafter. Each arm 54 has a slot 56 for purposes described below.

When soldering a coaxial cable shield to cable receiving part 44, it is desirable to use a soldering iron having a relatively small tip. Although it is desirable to dimension slots 56 wide enough to facilitate adequate solder flow throughout a slot, it should be narrow enough to prevent the relatively small tip of the soldering iron from contacting the shield of the coaxial cable, which could result in damage to the underlying dielectric of the cable. Each slot 56 is on the order of approximately 0.040 inch wide, although it is believed that such slot could be within the range of 0.010 to 0.110 inch wide.

Stamped blank "B" (FIG. 4) is formed into cable receiving part 44 as Shown in FIGS. 5 and 6. It can be seen that base 50 has been bent or formed intermediate its opposite ends so that end portions 52 now form a pair of opposing spring jaws. The tips of the spring jaws are flared outwardly to define a mouth 58 therebetween. Wings 54 of the blank are formed or curled inwardly as seen best in FIG. 6 to form four generally cylindrical receptacles 60. These receptacles are provided for receiving four coaxial cables, as described hereinafter. Therefore, once formed, cable receiving part 44 is provided with a pair of positioning and gripping arms 54 and a pair of receptacles 60 on each opposite side of jaws 52. In assembly, mouth 58 between the jaws receives a rear edge 62 (FIG. 3) of ground plate 32 of terminal part 42, as will be seen hereinafter. With this structure, the two-part: terminating member can terminate from one to four coaxial cables depending on the specification of the connector. In some computer applications, three cables may be used to carry the red, green and blue chroma signals for a monitor. A fourth cable might be used for flat screen monitors for carrying the pixel clock timing signals.

Figure 7:
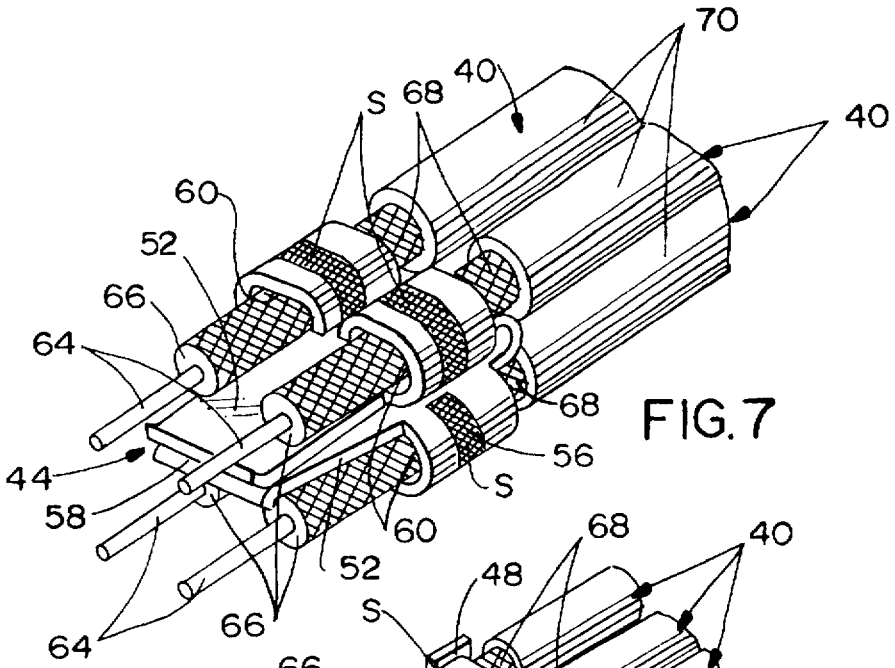
FIG. 7 is a perspective view of the cable receiving part receiving a plurality of coaxial cables.

FIG. 7 shows cable receiving part 44 terminated to four coaxial cables 40. At this point, it should be understood that each coaxial cable 40 is of a conventional construction in that each cable includes a center conductor or core 64 surrounded by a tube-like inner dielectric 66. A metallic shield in the form of a tubular metallic braid 68 surrounds inner dielectric 54. An insulating jacket 70, as of plastic or the like, surrounds metallic braid 68 to form the overall composite coaxial cable 40.

Figure 9:
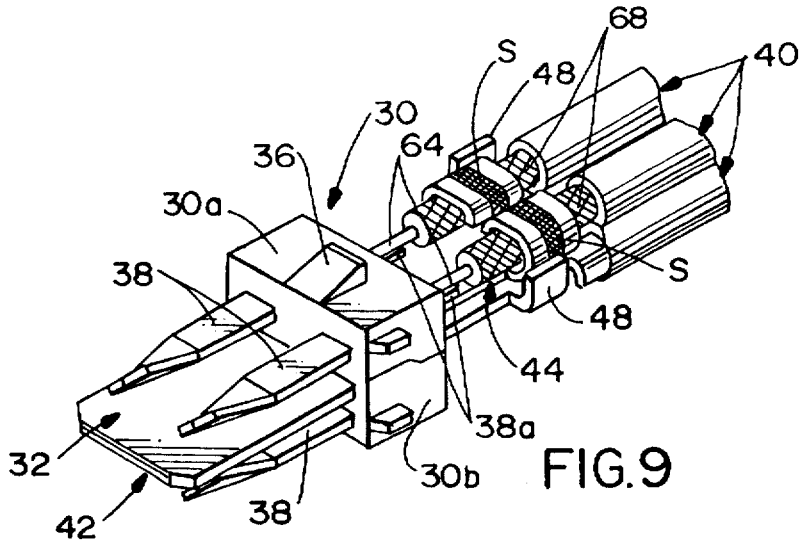
FIG. 9 is a perspective view of the terminal module mountable in the connector of FIGS. 1 and 2.

FIG. 7 also shows that center conductor/core 64 of each coaxial cable 40 has been stripped to expose a given length thereof which will be soldered, welded or otherwise secured to the inner end 38*a* of one of the high speed signal transmission terminals 38 (FIGS. 2 and 9). The outer insulating jacket 70 of each cable also has been cut-back to expose a given length of the respective metallic shield 68. Therefore, the exposed shield can be soldered to a respective one of the positioning and gripping arms 54 of cable receiving part 44 as discussed below. FIG. 7 shows the prepared coaxial cables inserted in proper alignment within receptacles 60 of arms 54, with the exposed metallic shields of the cables aligned with the arms.

The next step in processing the terminal module is to form or slightly crimp gripping arms 54 of cable receiving part 44 into gripping engagement with the coaxial cables about the exposed metallic shields as shown in FIG. 7. It should be understood that the gripping arms are not crimped onto the metallic shields as is typical in the crimping art. Rather, an amount of crimping force is used to slightly form the gripping arms inwardly, so as to only grip or retain the coaxial cables prior to soldering. The gripping or crimping pressure should not be excessive which might deform or damage the underlying inner dielectric material 66 of cables 40 to any extent, which may affect the electrical performance thereof.

Cable receiving part 44 then is mechanically and electrically connected to metallic shields 68 of the coaxial cables by soldering the metallic shields to gripping arms 54 by soldering through slots 56 in the gripping arms, as at "S" in FIG. 7. As stated above, the slots are formed on the order of 0.040 inch wide to prevent the application of concentrated heat directly to the metallic shields, which could cause heat damage to the underlying inner dielectric material. The slots should be sufficiently narrow to at least prevent whatever soldering iron or tool is used from passing through the slots and into direct engagement with the metallic shield. Such engagement may result in damaging the underlying inner dielectric. In essence, the slots restrict the amount of soldering heat which is transmitted inwardly to the inner dielectric material. On the other hand, with the slots extending in a circumferential direction as shown, the slots provide a large circumferential area of access to the metallic shields in a circumferential direction. Preferably, each slot extends at least approximately 180° around the respective coaxial cable.

In the alternative, it is believed that by using a coaxial cable having an inner dielectric that can withstand relatively high temperatures without deformation or degradation (such as aerated Teflon), it may be possible to eliminate the slots 56 in gripping arms 54. In such case, solder would be applied along the leading or trailing (or both) edges of the arms where they contact the metallic shields 68. In still another alternate embodiment, arms 54 again would not include slots 56 and some means on the inner surface of arms 54 for applying solder between the arms and the metallic shields 68 would be used. Such means could include a tin/lead plating, a solder top coat or a solder inlay on the inner surfaces of arms 54. The outer surfaces of the arms would be heated with a soldering iron or other tool, which would cause the plating, solder top coat or solder inlay to flow, interconnecting the inner surface of the arms to the metallic shields.

Figure 8:
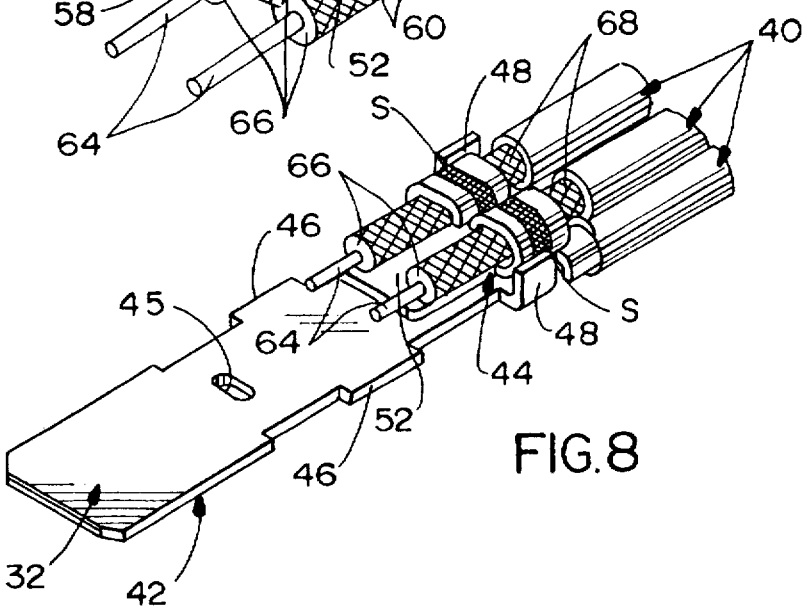
FIG. 8 is a perspective view of the cable receiving part and cables mounted on the terminal part.

Once coaxial cables 40 are mechanically and electrically connected to cable receiving part 44 as shown in FIG. 7, the cable receiving part is mounted to the rear end of terminal part 42 as shown in FIG. 8. This is accomplished by sliding the cable receiving part onto the terminal part in the direction of arrow "A" (FIG. 3). The rear edge 62 (FIG. 3) of ground plate 32 enters mouth 58 (FIG. 5) between gripping jaws 52 of the cable receiving part. Positioning arms 48 projecting from the ground plate properly position the cable receiving part laterally of the terminal part, as spring jaws 52 grip opposite sides of ground plate 32. If necessary, the two parts can be permanently soldered together by applying solder connections between spring jaws 52 of cable receiving part 44 and ground plate 32 of terminal part 42.

Once the subassembly of FIG. 8 is fabricated, including the soldering procedures, this subassembly is assembled to terminal blocks 30*a* and 30*b* including high speed signal transmission terminals 38 to form terminal module 30 as shown in FIG. 9 and described above in relation to FIG. 2. Center conductors/cores 52 of the coaxial cables are then connected, as by soldering, welding or otherwise securing to the inner ends 38*a* of terminals 38, while terminal blocks 30*a* and 30*b* clamp ground plate 32 of terminal part 42 therebetween, as shown in FIG. 2 and described above. The terminal module then is mounted within dielectric housing 12 as shown in FIG. 2. If desired, terminal blocks 30*a* and 30*b* could be mounted to ground plate 32 of terminal part 42 prior to mounting cable receiving part 44 thereon. In other words, ground plate 32 shown in FIG. 3 would have the terminal blocks mounted thereon at the beginning of the termination process.

The concepts of the invention have been shown and described herein in conjunction with terminating the metallic shields of coaxial cables 40 to a two-part terminating member including ground plate 32. However, it should be understood that the concepts of the invention are equally applicable for terminating the metallic shields to other types of terminating members, such as individual electrical terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A termination assembly comprising:

a pair of cables, each of said cables having an inner conductor, an inner dielectric surrounding at least a part of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a terminal to which said metallic shield is to be terminated, said terminal extending from a mating end towards a rear end with said mating end being adapted to mate with a complementary terminal, said terminal being at least partially disposed in a dielectric housing of an electrical connector and said terminal having a ground portion;

a discrete cable retaining member separate from said terminal and having a pair of gripping arms, each of said gripping arms having an elongated slot and being configured to be disposed about said exposed portion of said metallic shield of one of said cables so as to encircle a portion of said exposed portion of said metallic shield of said cable in order to grip said exposed portion of said metallic shield without deformation of said inner dielectric; and interengaging means for mounting said cable retaining member on said ground portion of said terminal spaced apart from said mating end.

2. The termination assembly of claim 1 wherein said interengaging means includes spring members for gripping said ground portion therebetween to maintain said cable retaining member on said ground portion.

3. The termination assembly of claim 2 wherein said gripping arms extend from one of said spring members to thereby form a pair of openings, each of said openings being adapted to receive said exposed portion of said metallic shield of one of said cables and wherein each of said openings is dimensioned such that said gripping arm and said spring member generally encircle said exposed portion of said metallic shield of said cable disposed therein.

4. The termination assembly of claim 1 wherein said exposed portion of said metallic shield is bonded to said gripping arm in which it is disposed by using said slot to solder said exposed portion to said gripping arm.

5. The termination assembly of claim 2 including at least one additional cable terminated to said cable retaining member, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination assembly further including a pair of additional gripping arms projecting from said cable retaining member, one of said additional gripping arms having an additional elongated slot and being configured to be disposed about said additional exposed portion of said additional metallic shield of said additional cable so as to encircle a portion of said additional exposed portion of said additional metallic shield of said additional cable in order to grip said additional metallic shield without deformation of said additional inner dielectric.

6. The termination assembly of claim 5 wherein said exposed portion of said metallic shield is bonded to said gripping arm in which it is disposed by using said slot to solder said exposed portion to said gripping arm and wherein said additional exposed portion of said additional metallic shield is bonded to said additional gripping arm in which it is disposed by using said additional slot to solder said additional exposed portion to said additional gripping arm.

7. A termination assembly comprising:

a pair of cable, each of said cables having an inner conductor, an inner dielectric surrounding at least a part of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a terminal to which said metallic shield is to be terminated, said terminal being at least partially disposed in a dielectric housing of an electrical connector and said terminal having a around portion, said ground portion including a pair of projecting arms disposed adjacent said gripping arms when said cable retaining member is disposed on said ground portion;

a cable retaining member having a pair of gripping arms, each of said gripping arm having an elongated slot and being configured to be disposed about said exposed portion of said metallic shield of one of said cables so as to encircle a portion of said exposed portion of said metallic shield of said cable in order to grip said exposed portion of said metallic shield without deformation of said inner dielectric; and interengaging means for mounting said cable retaining member on said ground portion of said terminal.

8. A termination assembly comprising:

a pair of cables, each of said cables having an inner conductor, an inner dielectric surrounding at least a part of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a terminal to which said metallic shield is to be terminated, said terminal being at least partially disposed in a dielectric housing of an electrical connector and said terminal having a around portion;

a cable retaining member having a pair of gripping arms, each of said gripping arms having an elongated slot and being configured to be disposed about said exposed portion of said metallic shield of one of said cables so as to encircle a portion of said exposed portion of said metallic shield of said cable in order to grip said exposed portion of said metallic shield without deformation of said inner dielectric;

at least one additional cable terminated to said cable retaining member, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield; and a pair of additional dripping arms projecting from said cable retaining member, one of said additional gripping arms having an additional elongated slot and being configured to be disposed about said additional exposed portion of said additional metallic shield of said additional cable so as to encircle a portion of said additional exposed portion of said additional metallic shield of said additional cable in order to grip said additional metallic shield without deformation of said additional inner dielectric;

interengaging means for mounting said cable retaining member on said ground portion of said terminal, said interengaging means including spring members for gripping said around portion therebetween to maintain said cable retaining member on said around portion, said spring members extending from a common bight portion so as to form a space therebetween with each of said spring members having a first side facing away from said space and a second side facing each other and said gripping arms maintaining said pair of cables on said first side of one of said spring members and said additional gripping arms maintaining said additional cable on said first side of said other of said spring members such that said pair of cables is maintained on one side of said ground portion and said additional cable is maintained on the other side of said ground portion when said spring members grip said ground portion such that said ground portion is disposed in said space between said second sides of said spring members.

9. The termination assembly of claim 8 wherein said ground portion includes a generally planar ground plate, wherein said ground plate includes a pair of projecting arms disposed adjacent said gripping arms when said cable retaining member is disposed on said ground plate and wherein said ground plate includes a pair of additional projecting arms disposed adjacent said additional gripping arms when said cable retaining member is disposed on said ground plate.

* * * * *